United States Patent [19]

Björk et al.

[11] 4,410,318

[45] Oct. 18, 1983

[54] METHOD AND ARRANGEMENT TO WATCH OVER SEPARATED SEDIMENT, WHICH IS THROWN OUT THROUGH NOZZLES OF A CENTRIFUGAL SEPARATOR

[75] Inventors: Johan E. G. Björk, Hägersten; Kaj Lindfors, Tumba; Klaus H. D. Stroucken, Rönninge, all of Sweden

[73] Assignee: Alfa Laval AB, Tumba, Sweden

[21] Appl. No.: 302,740

[22] Filed: Sep. 16, 1981

[30] Foreign Application Priority Data

Sep. 26, 1980 [SE] Sweden ..... 8006732

[51] Int. Cl.[3] ..... B01F 1/00; B01F 9/14

[52] U.S. Cl. ..... 494/10; 494/82

[58] Field of Search ..... 494/1, 10, 7, 2, 5, 494/11, 56, 82, 84; 340/606, 608, 609, 611, 604

[56] References Cited

U.S. PATENT DOCUMENTS

| | | | |
|---|---|---|---|
| 3,642,196 | 2/1972 | Raymond | 494/10 |
| 3,701,469 | 10/1972 | Nilsson | 494/2 |
| 3,752,389 | 8/1973 | Nilsson | 494/1 |
| 3,777,972 | 12/1973 | Kjellgren | 494/48 |
| 3,986,663 | 10/1976 | Jonsson | 494/10 |
| 4,015,773 | 4/1977 | Thylefors | 494/40 |
| 4,191,325 | 3/1980 | Stroucken | 494/40 |
| 4,206,871 | 6/1980 | Nilsson | 494/10 |

*Primary Examiner*—Robert W. Jenkins

[57] ABSTRACT

At a centrifugal separator (21), where separated sediment is thrown out in jets (26) from the rotor (22) of the separator through a determined number of nozzles (1, 2, 3) a sensing means (28) is arranged to be influenced by the respective jet and give off a signal (U), which is a measure of a quantity, e.g. the flow, of the medium of the jet, which signals (U) are given off to an apparatus (38), which is arranged to record the signals (U) and in its turn give off a signal (39, 39A, 39B, 39C), if said quantity of the medium in one or more jets is changed, e.g. if the flow through a nozzle ceases by the nozzle having been blocked or if the flow through a nozzle has increased by the nozzle having been eroded.

15 Claims, 8 Drawing Figures

Fig. 1
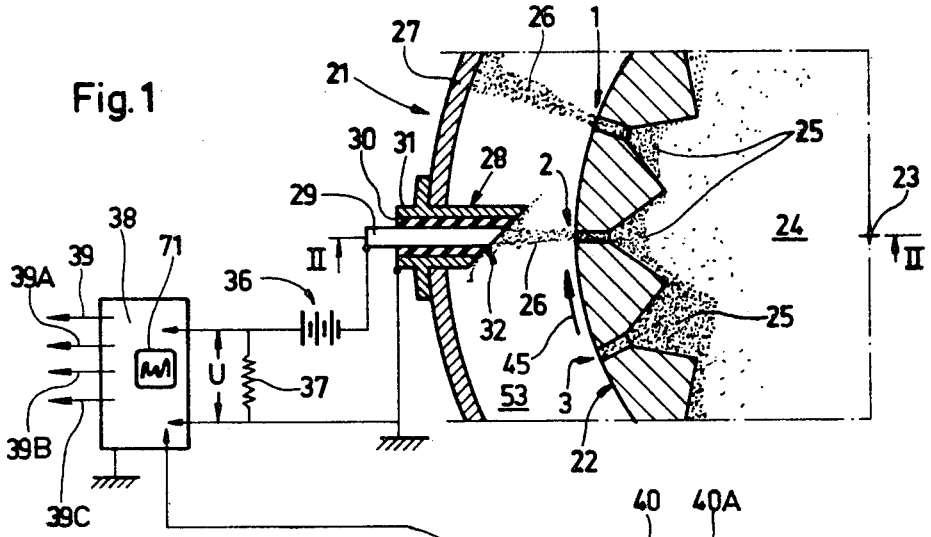
Fig. 2
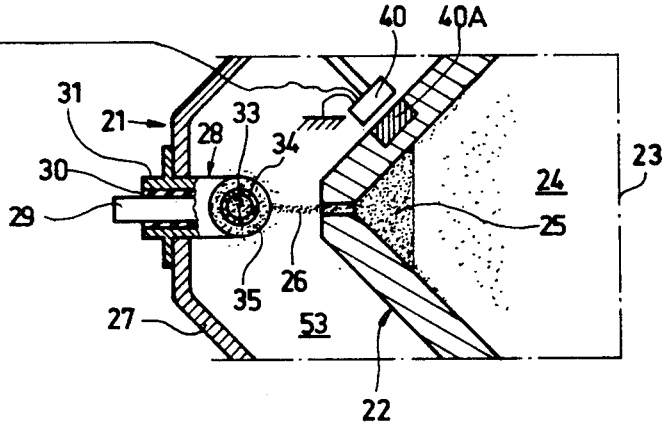
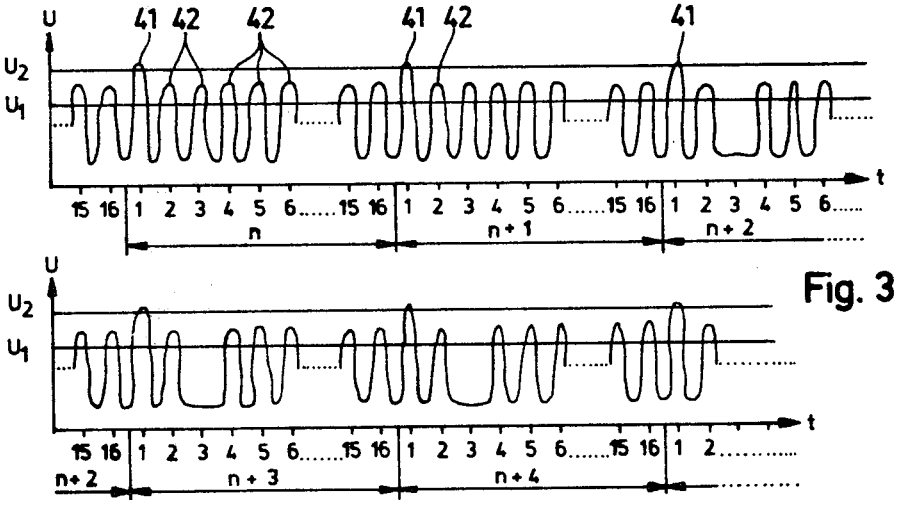
Fig. 3

METHOD AND ARRANGEMENT TO WATCH OVER SEPARATED SEDIMENT, WHICH IS THROWN OUT THROUGH NOZZLES OF A CENTRIFUGAL SEPARATOR

The present invention relates to a method of monitoring the discharge of separated sediment which is thrown out in jets from the rotor of a centrifugal separator through a number of nozzles. The invention also relates to a system for carrying out the method.

A centrifugal separator of this kind may have a rotor which cannot be opened and closed during the operation of the rotor and from which sediment is continuously thrown out through a number of nozzles.

A centrifugal separator of this kind may also have a rotor which can be opened during operation of the rotor by two parts of the rotor being moved from each other and from which sediment is continuously thrown out through nozzles formed in the partition surface between said parts, e.g., according to U.S. Pat. No. 4,191,325, or through nozzles positioned at a distance from said partition surface, e.g., according to U.S. Pat. No. 3,777,972.

Such a centrifugal separator can also be according to U.S. Pat. No. 4,015,773 so as to have a rotor from which sediment intermittently, during certain emptying periods, is thrown out from the rotor through nozzles which are simultaneously openable during the operation of the rotor.

In separators of said kind, certain disturbances occur which react on a quantity of the medium thrown out through the respective nozzles. A nozzle which becomes blocked creates such a disturbance. This disturbance reacts on the flow through the nozzle so as to decrease the flow rate or stop the flow entirely through the blocking.

When a nozzle becomes blocked, the sediment which is collected behind the blocked nozzle causes an imbalance of the rotor, which creates mechanical stresses which can damage the rotor. These stresses are largest when the rotor passes its critical rotation speeds as it is brought to stop. Said imbalance furthermore increases with time, as the sediment which is located inside a blocked nozzle becomes heavier by gradually being impoverished of lighter liquid phase, which leaves the sediment in a direction towards the center of the rotor.

When a nozzle has become blocked, the flow of sediment to the adjacent nozzles gradually increases, the risk increasing that these shall also become blocked. When two or three nozzles which are positioned adjacent each other are blocked, the imbalance is substantially increased.

The sediment which is collected behind a blocked nozzle will gradually grow inwards between the conical separating discs of the rotor and be caught by the lighter liquid phase and be carried with it through its outlet from the rotor, the separating result thereby being deteriorated.

Heretofore blocking of nozzles has been indicated by a means arranged on the separator and which senses the vibrations caused by an imbalance of the rotor due to one or more blocked nozzles. However, such a vibration sensing means reacts slowly to a blocked nozzle, as a considerable imbalance is required of the rotor in order that the vibration sensing means shall react on the imbalance, and furthermore it takes a certain time for said considerable imbalance to develop when a nozzle has become blocked.

A nozzle which has become eroded by sediment flowing out also creates such a disturbance. This disturbance reacts on the flow through the nozzle so as to increase the flow rate through the erosion. Such an increasing flow rate means that the concentration of sediment in the jet decreases, which is a drawback because it is generally desirable to have a constant concentration of sediment in the medium which leaves the sediment outlet of the separator.

A change of the flow of mixture of sediment and lighter liquid phase which is supplied to the rotor or a change of the concentration of sediment in said mixture also creates such a disturbance as this causes the concentration of sediment in the jets to be changed in a way not desired. This disturbance reacts in general on the conductivity, i.e., the conductivity quantity, of the medium in the jets.

The object of the invention is to obtain a method and system which at an early stage provides information whether said kinds of disturbances arise, so that one in good time can take steps so that the inconveniences accounted for shall not arise.

This object is attained with the method according to the invention in that one lets a sensing means be influenced by the sediment jets and, as a measure of a quantity of the medium of each sensed sediment jet, give off a signal to an apparatus which records the signals and in its turn gives off a signal if said quantity of the medium in one or more jets is changed. Said object is attained with the system according to the invention in that a sensing means, known per se, is arranged to be influenced by the sediment jets, the sensing means being arranged to give off a signal as a measure of a quantity of the medium of each sensed sediment jet. These signals are sent to an apparatus arranged on the one hand to record the signals and on the other hand to give off a signal if said quantity of the medium of one or more jets is changed.

For example, if one or more jets decrease as to flow rate or cease to be thrown out from the rotor, the apparatus will immediately give a signal about this. The system according to the invention will react substantially quicker and safer on a blocked nozzle than the known vibration sensing means.

According to a development of the method according to the invention, the apparatus during a predetermined number of revolutions of the rotor sums up the magnitude of the recurrent signals from each nozzle jet and, with the aid of the summed up signal magnitudes, gives off a signal if said quantity of the medium of one or more jets is changed. According to a development of the system according to the invention, the apparatus during a predetermined number of revolutions of the rotor sums up the magnitude of the recurrent signals from each nozzle jet and, with the aid of the summed up signal magnitudes, gives off a signal if said quantity of the medium in one or more jets is changed. In this way it is possible to use less sensitive sensing means, and the influence of noise and accidental irrelevant signals from the sensing means can be eliminated. For example, an accidental blocking of a nozzle, which blocking thereafter is spontaneously removed, will not release a signal from the apparatus.

According to a further development of the invention, the apparatus gives off a signal if the magnitude of one or more of the signals from the sensing means is below a certain value. This is a simple way to get information if certain kinds of disturbances have occurred. For example, if said signal from the apparatus is given off when a nozzle has become blocked, the signal will not be given off when a nozzle has become eroded.

According to another development of the invention, the apparatus gives off a signal if the magnitude of one or more of the signals from the sensing means is above a certain value. This is a simple way to get information if certain other kinds of disturbances have occurred. For example, if said signal from the apparatus is given off when a nozzle has become eroded, the signal will not be given off when a nozzle has become blocked.

According to further developments of the invention, the apparatus gives off a signal if the magnitude of the majority of the signals from the sensing means is below a certain value and gives off another signal if the magnitude of the majority of the signals from the sensing means is above a certain value. This makes it possible to still more accurately determine the kind of the disturbance.

The jets which are thrown out from the rotor can be sensed by different means. According to a development of the system according to the invention, the sensing means has two electrically conducting surfaces which are part of an electric circuit and which are separated from each other by an electrically insulating surface. These surfaces are so directed towards the medium being thrown out that it hits the surfaces and bridges the interspace so as to decrease the resistance of the circuit. The latter is arranged to give off an electric signal to the apparatus, the magnitude of the electric signal being changed when said resistance is changed.

It has proved that this arrangement can be made very sensitive. The magnitude of the electric signal to the apparatus can easily be increased so as to increase the amperage through the circuit. By this the sensitivity of the sensing means can be increased, so that one obtains a sufficiently large electric signal to the apparatus even when media with small conductivity hit the sensing means. This arrangement is naturally usable only for electrically conducting media. In practice this does not imply any substantial limitation, as most media thrown out from separator rotors have a conductivity which is so large that they are compatible with this arrangement.

According to another development of the system according to the invention, the sensing means comprises an element arranged to be hit by the respective jets and be put into mechanical vibrations. These vibrations are transferred to a piezoelectric crystal which gives off an electric signal in the form of voltage pulses with the same frequency as the vibrations to the apparatus. This arrangement has the advantage that it does not depend on whether the medium is conductive or not. The sensing means itself is known per se through U.S. Pat. No. 4,206,871, where it is used with quite another arrangement, namely, an arrangement for indicating if leakage arises from a separator rotor from which normally no medium at all is to be thrown out.

According to another development of the system according to the invention, the sensing means comprises a microphone located in the vicinity of the path of the jets and senses the sound energy which the respective jets generate. This form of sensing means has the advantage that it can be located beside the path of the jets and thus avoid erosion by the jets. The microphone does not need to be located inside the space where the jets are thrown out but may be located outside said space, possibly abutting the cover against the inside of which the sediment is thrown.

Different embodiments of the invention and their modes of operation are described below in connection with the attached drawings in which FIG. 1 is part of a cross-sectional view of a centrifugal separator where medium is thrown out from the rotor and hits a sensing means which senses the capability of the medium to conduct electric current and is connected to an apparatus according to the invention;

FIG. 2 is a sectional view according to the marking II—II in FIG. 1;

FIG. 3 is a graph showing how the electric voltage of signals, which the sensing means causes, varies when medium from different nozzles hits the sensing means;

Figure 4:
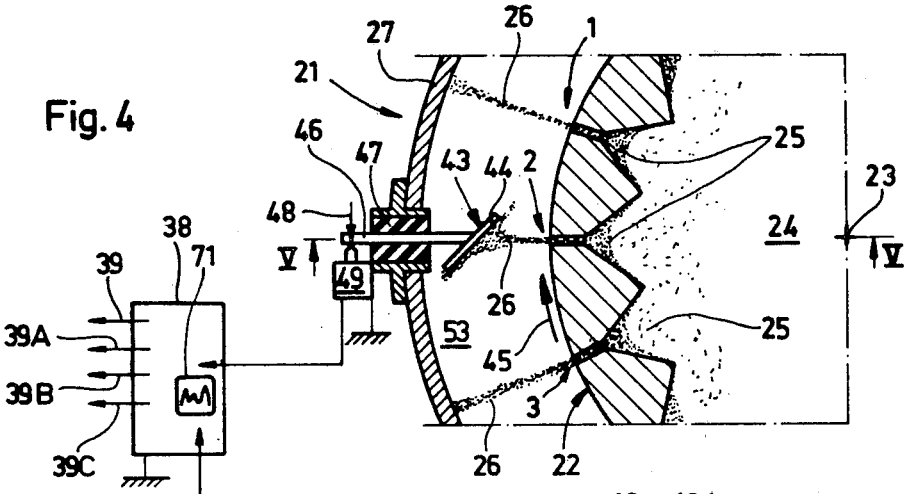
FIG. 4 is a view similar to FIG. 1 and showing the same centrifugal separator and apparatus as FIG. 1 but with another sensing means, which senses the force by which medium thrown out acts on the sensing means.
Figure 7:
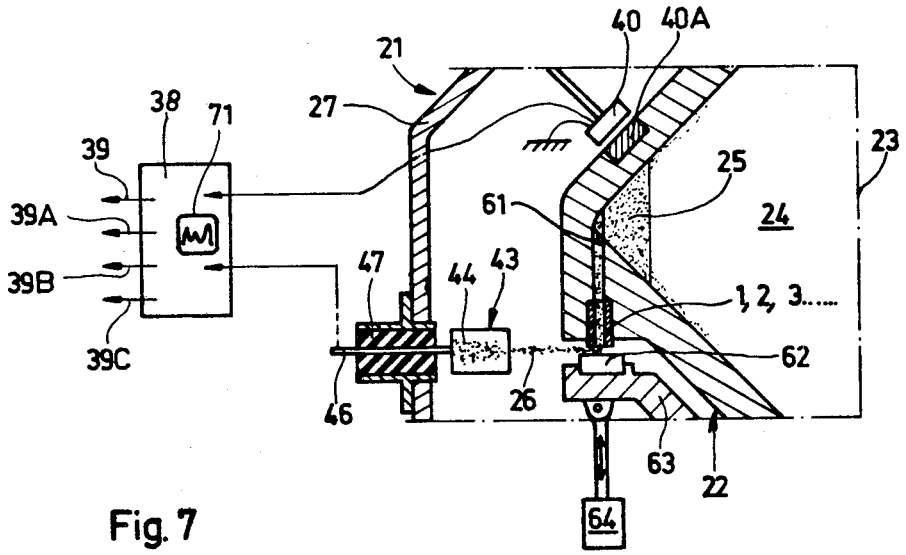
Figure 8:
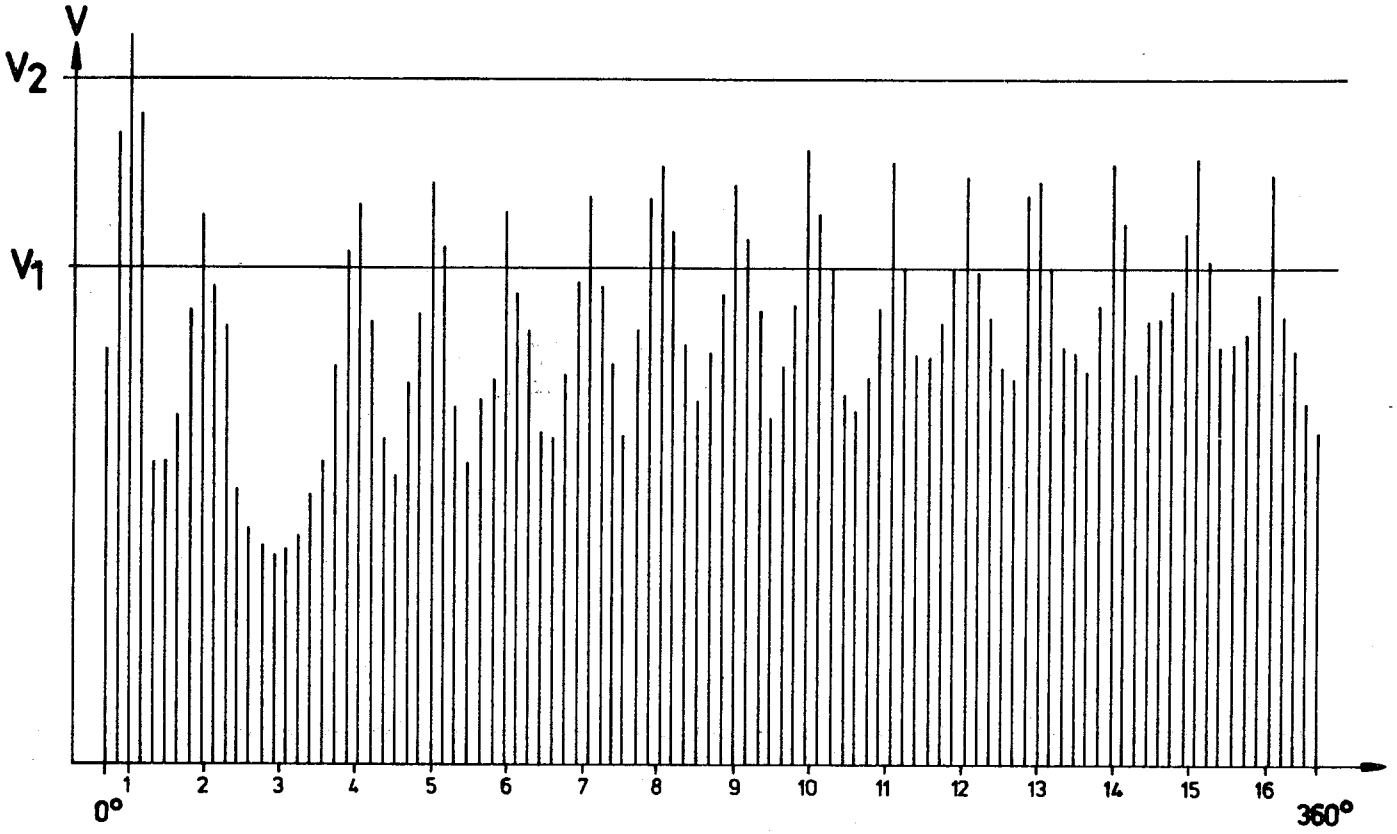

FIG. 7 is part of a longitudinal sectional view of a centrifugal separator with a rotor having nozzles which are openable during operation and where the medium thrown out acts on the same sensing means as is shown in FIG. 4; and FIG. 8 is a graph showing the result of a signal treatment which the apparatus carries out as a basis for establishing if a nozzle has become blocked by sediment or if any other disturbance has occurred.

With reference to FIG. 1, numeral 21 designates a centrifugal separator comprising a rotor 22 having a plurality of nozzles 1, 2, 3 . . . , which in the shown embodiment are sixteen in number. The respective nozzles have a circular cross-section, and they are evenly distributed along the periphery of the rotor and located in a common plane which is perpendicular to the axis 23 of the rotor.

The interior 24 of the rotor is continuously supplied with a mixture in liquid state of heavier and lighter constituents through supply means (not shown). The heavier constituents, the sediment, are separated from the lighter constituents by action of the centrifugal force and are collected in pockets 25, from which they are continuously thrown out through the nozzles in the form of jets 26.

The rotor 22 is enclosed in a cover 27, which collects the sediment thrown out through the nozzles. If one or more nozzles become blocked, as the nozzle 3, heavier constituents are accumulated behind the blocked nozzle and the rotor loses its balance so that its vibration level is considerably increased, which is harmful to the separator.

In order to give an alarm if some nozzle is blocked, a sensing means 28 is inserted in the cover 27. The sensing means 28 comprises a central, electrically conducting element 29 surrounded by a sleeve-formed, electrically insulating element 30 which in its turn is surrounded by a sleeve-formed, electrically conducting element 31.

The sensing means 28 has a smooth end surface 32 which is formed of the three elements 29, 30 and 31 and to which the element 29 contributes with a central, circular, electrically conducting surface 33, the element 30 contributes with an annular, electrically insulating surface 34, and the element 31 contributes with an annular, electrically conducting surface 35.

The means 28 is in an electric circuit which comprises a direct current source 36 and a resistance 37. By the resistance in the insulation 30 being relatively large, the circuit 28-36-37 will be substantially currentless when the surface 32 is clean and freed from any electrically conducting coating. The surface 32 is so directed towards the jets 26 that it is hit by the jets in turn when they pass by.

The medium of the jets is presupposed to be electrically conductive. Each time the surface 32 is hit, the medium will bridge the electrically insulating surface 34 and establish contact between the surfaces 33 and 35, a current going through the circuit 28-36-37 so that the voltage U over the resistance 37 increases and produces a voltage pulse. The more medium that hits the surface 32, i.e., the larger the flow rate of medium in the jet is, the larger the voltage U of the voltage pulse will be. At a constant flow rate, an increase of the conductivity of the medium will furthermore cause an increase of the voltage U. These voltage pulses are conducted to an apparatus 38 which records the voltage pulses from the hits of the jets on the surface 32 and gives off a signal 39, when the voltage U of a voltage pulse goes below a certain value. The apparatus 38 may comprise a counter which counts the number of voltage pulses which exceed a certain voltage during a predetermined number of revolutions of the rotor, and a means which indicates when the rotor has rotated said predetermined number of revolutions. When the number of said voltage pulses during the predetermined number of revolutions goes below the number of nozzles which pass by during the predetermined number of revolutions, the signal 39 is given off to an alarm device or to a means to break off the operation of the rotor.

One reason for the signal 39 being given off can be that a nozzle has become blocked. Another reason can be a general decrease of the conductivity of the medium which leaves the rotor through the nozzles. Such a general decrease of the conductivity can be caused by a disturbance on the inlet side of the rotor, e.g., if the flow of mixture to the rotor has been changed or has ceased or if the concentration of sediment in the mixture has been changed.

Said means for indicating when the rotor has rotated one revolution comprises a sensing means 40 which gets a pulse from a permanent magnet 40A fastened to the rotor 22. The sensing means 40 gives off a pulse for each revolution that the rotor rotates.

When a jet 26 has passed the surface 32, gaseous medium surrounding the rotor 22 will blow the surface 32 substantially clean from remaining medium, the voltage U over the resistance decreasing to a minimum until a new jet 26 hits the surface 32 and brings about a new voltage pulse.

In FIG. 3 is shown how the voltage U over the resistance 37 may vary with time t, when medium from the rotating rotor hits the sensing means 28. In the beginning of a certain revolution, n, of the rotor, the jet 26 from the nozzle 1 hits the sensing means 28. The nozzle 1 has been eroded by the sediment flowing out, so that the flow rate through the nozzle 1 is larger than the flow rate through the other nozzles. The jet from nozzle 1 will therefore cause a voltage pulse 41 which has a larger maximum voltage than the voltage pulses 42 caused by the jets from the other nozzles. During the next revolution, n+1, the flows through the respective nozzles have not been changed, so that the same pulse picture as during the preceding revolution, n, recurs.

During the next revolution, n+2, the nozzle 3 has suddenly become blocked, whereby a voltage pulse from this nozzle fails to appear on the pulse picture. The pulse picture for the subsequently shown revolutions, n+3 and n+4, shows that the nozzle 3 remains blocked.

Said counter of the apparatus 38 counts all the voltage pulses which have a voltage higher than a suitable chosen value $U_1$. When the number of such voltage pulses goes below the number of nozzles which pass the sensing means 28, the apparatus 38 observes this and gives off the signal 39. The apparatus 38 can also be arranged so that it does not give off the signal 39 at the first signal from the counter that a voltage pulse has a voltage below $U_1$, but it waits to do so until the rotor has rotated a further number of revolutions. A blocking of a nozzle can at an early stage after it has arisen be spontaneously removed, and then it is unnecessary that the signal 39 be given off.

The apparatus is also provided with means which gives off a signal 39A if the voltage of the majority of the voltage pulses 41, 42 goes below $U_1$. Said means may comprise a counter which counts possible remaining voltage pulses having a voltage exceeding $U_1$. When the signal 39A is given off, this indicates that a disturbance has occurred on the inlet side of the rotor, e.g., that the flow of mixture to the rotor has been changed or has ceased or that the concentration of sediment in the supplied mixture has been changed. If both the signal 39 and the signal 39A are given off, this indicates that any of last-mentioned kinds of disturbances has occurred. If only the signal 39 is given off, this indicates that one or some nozzles have become blocked.

The apparatus is furthermore provided with means which give off a signal 39B if the flow rate of the jets exceeds a certain value corresponding to a certain chosen voltage $U_2$, which is larger than $U_1$. The signal 39B will thus be given off when a nozzle has been eroded to a certain degree. Another cause for the signal 39B being given off can be a general increase of the conductivity of the medium which leaves the rotor through the nozzles. Such a general increase of the conductivity can be caused by a disturbance on the inlet side of the rotor, as by the flow of mixture to the rotor having been changed or the concentration of sediment in the mixture supplied to the rotor having been changed.

The apparatus 38 is also provided with means which give off a signal 39C if the voltage of the majority of the voltage pulses 41, 42 exceeds $U_2$. Said means may comprise a counter which counts all voltage pulses having a voltage exceeding $U_2$. When the signal 39C is given off, this indicates that a disturbance has occurred on the inlet side of the rotor, e.g., that the flow of mixture to the rotor has been changed or that the concentration of sediment in the mixture has been changed. If both the signal 39B and the signal 39C are given off, this indicates that any of the last-mentioned kinds of disturbances has occured. If only the signal 39B is given off, this indicates that one or some nozzles have become eroded.

Figure 5:
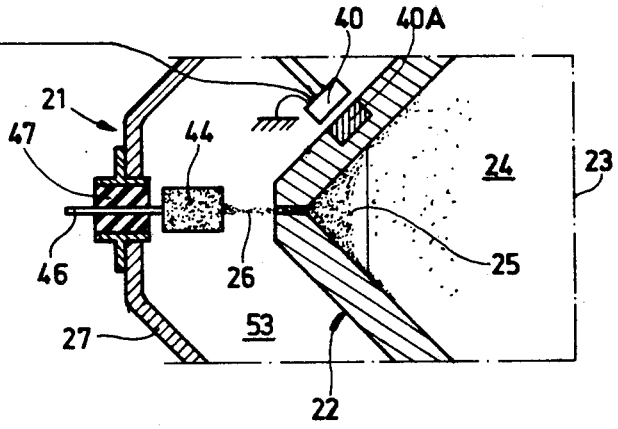
FIG. 5 is a sectional view according to the marking V—V in FIG. 4.

The embodiment according to FIGS. 4 and 5 differs from the one shown in FIGS. 1 and 2 only in the sensing means 43, which comprises a disc 44 arranged to be hit by the jets 26 when the rotor rotates in the direction indicated by arrow 45. The disc 44 is fastened to a rod 46 which is elastically mounted in a rubber sleeve 47. When the disc 44 is hit by a jet, the rod 46 is put into mechanical vibrations of a predetermined frequency, which vibrations are transmitted in the direction of arrow 48 to a piezo-electric crystal 49 arranged at one end of the rod 46. These vibrations are transformed by the crystal 49 into voltage pulses with the same frequency as the vibrations, which voltage pulses are given off to the apparatus 38 as a signal that the sensing means 43 has been hit by a jet 26. The larger the force from a jet 26 on the disc 44 is (i.e., the larger the flow rate of the jet is) the larger becomes the signal from the crystal 49 to the apparatus 38. The signals from the crystal 49 will get substantially the same appearance as the signals shown in FIG. 3, and the apparatus 38 also treats them in the same way as in the arrangement according to FIGS. 1 and 2 to establish whether the signals 39, 39A, 39B or 39C shall be given off.

Figure 6:
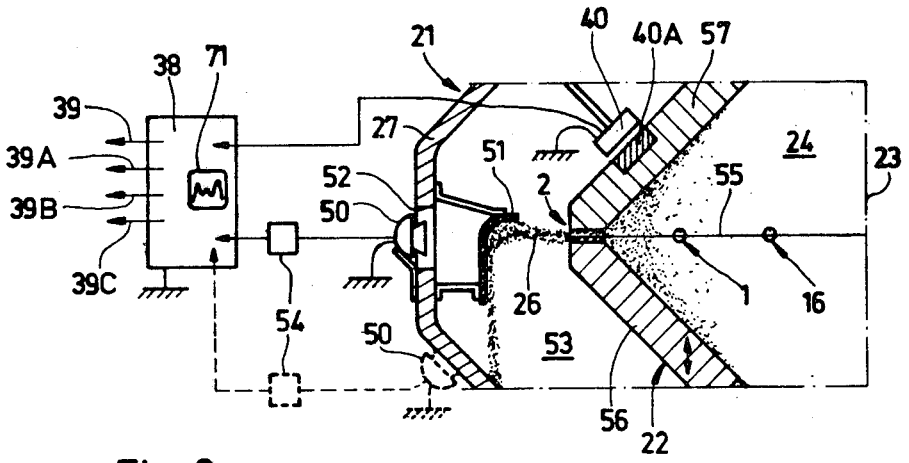
FIG. 6 is part of a longitudinal sectional view of a centrifugal separator with a rotor which is openable during operation and where medium which is thrown out through nozzles of the rotor influences a microphone connected to the apparatus.

In the embodiment shown in FIG. 6, the sensing means comprises a microphone 50 which is arranged in the vicinity of the path of the jets 26 and senses the sound energy which the respective jets produce. The microphone is located behind an annular screen 51 which is hit by the jets 26, and it senses through an opening 52 in the cover 27 the sound pulses which arise behind the screen 51 inside the sediment collecting space 53 when the jets pass by. These sound pulses are transformed by the microphone 50 into electric pulses which get substantially the same appearance and are treated by the apparatus 38 in the same way as the pulses in FIG. 3.

The microphone 50 can also be arranged on the outside of the wall of the cover 27 (as indicated by dotted lines) and sense the sound from the jets through the wall. Suitably a filter 54 is provided which filters out low frequency sound from the machine and the surroundings and only lets signals of high frequency through to the apparatus 38 so that the best result with the arrangement is obtained.

The arrangement according to the invention is suitable for use in the type of separators which has a rotor provided with nozzles and is openable during operation. Such a rotor 22 is shown in FIG. 6. The nozzles 16, 1, 2 are formed in the partition surface 55 between two parts 56 and 57 which, during operation of the rotor, are displaceable relative to each other in the axial direction of the rotor to bring the interior 24 of the rotor into communication with the sediment collecting space 53, medium flowing out of the rotor and flushing the surfaces clean which surround and form the nozzles. Some sediment has a tendency after blocking of a nozzle to gradually stick to it, so that it is important as soon as possible after a blocking to open the rotor to flush the blocking away, which thus becomes possible with the arrangement according to the invention.

The arrangement according to the invention is also suitable for use with the type of separators having a rotor with nozzles which are openable during operation. Such a rotor 22 is shown in FIG. 7. The nozzles 1, 2, 3 . . . communicate with the respective pocket 25 through an axial channel 61 and discharge axially in the direction towards a seat 62. The seats 62 are arranged in a common operating ring 63 which is displaceable towards and away from the nozzles by a motor 64. FIG. 7 shows a moment during a discharge period, all the seats 62 being moved away from the nozzles 1, 2, 3 . . . and the sediment being thrown out in jets 26. The sediment influences a suitable sensing means such as means 43 shown in FIGS. 4 and 5.

The apparatus is suitably kept connected up only during the discharge periods. This may be accomplished by simultaneously activating the motor 64 to open the nozzles 1, 2, 3 and giving the apparatus 38 a signal to begin to operate.

The apparatus 38 will, for example, give off the signal 39 if one or more of the nozzles 1, 2, 3 . . . are blocked during the discharge periods.

In FIG. 8 is shown how the action of noise, accidental irrelevant signals and accidental blockings, which are spontaneously removed, can be eliminated by the apparatus 38. For instance, the apparatus 38 records for every 3.6° rotation of the rotor in relation to a fixed angle position (e.g., the position of the sensing means 40) the magnitude of the signal from the sensing means. For each such angle position the magnitudes of the signals are summed up when the rotor 22 rotates a certain amount (e.g., 400 revolutions), a picture of the summed up signal magnitudes V according to FIG. 8 being obtained. By choosing a suitable level $V_1$, it can be established if impulses from one or more nozzles have decreased in magnitude. In FIG. 8 an impulse from nozzle No. 3 is missing, which thus is certainly blocked. By choosing another suitable level $V_2$, it can be established if impulses from one or more nozzles have increased as to magnitude. In FIG. 8 the impulse from nozzle No. 1 reaches over $V_2$, which probably means that nozzle No. 1 is eroded.

The apparatus 38 can be provided with an oscilloscope 71 for displaying the pulse pictures shown in FIGS. 3 and 8. By the permanent magnet 40A taking a fixed position relative to the nozzles, it can be established on the oscilloscope picture which part of the pulse picture belongs to a certain nozzle. By means of the oscilloscope, it is possible to study the condition of the individual nozzles and establish which one or which ones are blocked or eroded.

When the sensing means shown in FIGS. 1 and 2 is used, it is possible to establish from the oscilloscope if the medium in the jets generally has changed its conductivity, which indicates a disturbance on the inlet side of the rotor, e.g., that the flow of mixture to the rotor has been changed.

We claim:

1. In the operation of a centrifugal separator having a rotor with a predetermined number of nozzles through which separated sediment is discharged in jets from the rotor, a method of monitoring said discharge of the jets which comprises directing said jets to influence a sensing means, causing said sensing means to give off a signal representing a measure of the quantity of a medium in each sensed jet, recording said signals in a recording apparatus, and using said recorded signals to give off a further signal from said apparatus if said quantity of the medium in at least one of the jets is changed.

2. The method of claim 1, in which said apparatus is caused, during a predetermined number of revolutions of the rotor, to sum up the magnitude of the recurrent signals from each jet, said summed up signal magnitudes being used to give off said further signal.

3. The method of claim 1 or 2, in which said apparatus is caused to give off a further signal if the magnitude of at least one of said signals from the sensing means is below a predetermined value.

4. The method of claim 1 or 2, in which said apparatus is caused to give off a further signal if the magnitude of at least one of said signals from the sensing means is above a predetermined value.

5. The method of claim 1 or 2, in which said apparatus is caused to give off a further signal if the magnitude of the majority of said signals from the sensing means is below a certain value.

6. The method of claim 1 or 2, in which said apparatus is caused to give off a further signal if the magnitude of the majority of said signals from the sensing means is above a certain value.

7. In combination with a centrifugal separator having a rotor with a predetermined number of nozzles through which separated sediment is discharged in jets from the rotor, a system for monitoring said discharge and comprising a sensing means positioned to be influenced by said jets, said sensing means being operable to emit a signal representing a measure of the quantity of a medium in each said jet, and an apparatus associated with said sensing means for receiving and recording said signals, said apparatus including means for emitting a further signal in response to a change in said quantity of the medium in at least one of the jets.

8. The system of claim 7, in which said emitting means includes means for summing up the magnitude of the recurrent signals from each jet during a predetermined number of revolutions of the rotor, said further signal being emitted under control of the summed up signal magnitudes.

9. The system of claim 7 or 8, in which said emitting means is operable to give off said further signal if the magnitude of at least one signal from the sensing means is below a predetermined value.

10. The system of claim 7 or 8, in which said emitting means is operable to give off said further signal if the magnitude of at least one signal from the sensing means is above a predetermined value.

11. The system of claim 7 or 8, in which said emitting means is operable to give off said further signal if the magnitude of the majority of the signals from the sensing means is below a predetermined value.

12. The system of claim 7 or 8, in which said emitting means is operable to give off said further signal if the magnitude of the majority of the signals from the sensing means is above a predetermined value.

13. The system of claim 7 or 8, in which the sensing means comprises an electric circuit including two electrically conducting surfaces and an electrically insulating surface separating said conductive surfaces, said surfaces being so positioned that each jet strikes said surfaces and bridges said insulating surface, thereby decreasing the resistance of the circuit, said signals from the sensing means being electric signals emitted by said circuit, the magnitude of each electric signal varying in response to a change of said resistance.

14. The system of claim 7 or 8, in which the sensing means comprises a vibratory element positioned to be struck by each jet and thereby undergo mechanical vibrations, the sensing means also including a piezoelectric crystal to which said vibrations are transmitted, said crystal being operable to emit to said apparatus an electric signal in the form of voltage pulses with the same frequency as said vibrations.

15. The system of claim 7 or 8, in which the sensing means comprises a microphone located in the vicinity of the path of the jets and operable to sense the sound energy generated by each jet.

* * * * *